US005914561A

United States Patent [19]

Venkatarao et al.

[11] Patent Number: 5,914,561

[45] Date of Patent: Jun. 22, 1999

[54] SHORTENED PROFILE PHOTOMULTIPLIER TUBE WITH FOCUSING ELECTRODE

[75] Inventors: Anita S. Venkatarao, Lancaster; Charles M. Tomasetti, Leola, both of Pa.

[73] Assignee: Burle Technologies, Inc., Wilmington, Del.

[21] Appl. No.: 08/916,097

[22] Filed: Aug. 21, 1997

[51] Int. Cl.[6] ..... H01J 43/06; H01J 43/18

[52] U.S. Cl. ..... 313/533; 313/536

[58] Field of Search ..... 313/532, 533–536, 313/541, 542, 544; 250/207

[56] References Cited

U.S. PATENT DOCUMENTS

| | | | |
|---|---|---|---|
| 4,306,171 | 12/1981 | Faulkner et al. | 313/95 |
| 4,311,939 | 1/1982 | Faulkner et al. | 313/95 |
| 4,341,427 | 7/1982 | Tomasetti et al. | 316/1 |
| 4,575,657 | 3/1986 | Kaiser | 313/533 |
| 4,604,545 | 8/1986 | McDonie et al. | 313/105 CM |
| 4,956,576 | 9/1990 | L'Hermite | 313/533 |
| 5,043,628 | 8/1991 | Boutot et al. | 313/532 |
| 5,363,014 | 11/1994 | Nakamura | 313/533 |
| 5,578,891 | 11/1996 | Sakai et al. | 313/103 R |
| 5,598,061 | 1/1997 | Nakamura et al. | 313/532 |
| 5,616,987 | 4/1997 | Ohmura et al. | 313/533 |

FOREIGN PATENT DOCUMENTS

| | | | |
|---|---|---|---|
| 0571201 | 11/1993 | European Pat. Off. | H01J 43/04 |

*Primary Examiner*—Sandra O'Shea
*Assistant Examiner*—Michael Day
*Attorney, Agent, or Firm*—Dann, Dorfman, Herrell and Skillman, PC.

[57] ABSTRACT

A photomultiplier tube is disclosed having a first dynode array and a second dynode array oriented substantially orthogonal to the first dynode to provide a shortened profile. The first dynode array is preferably a box-and-grid dynode array and the second dynode array is preferably an in-line dynode array. A focusing electrode is positioned between the last dynode of the first dynode array and the first dynode of the second dynode array. The focusing electrode is constructed and arranged to facilitate the transfer of electrons emitted from the first dynode array to the second dynode array without generating secondary electrons.

19 Claims, 5 Drawing Sheets

SHORTENED PROFILE PHOTOMULTIPLIER TUBE WITH FOCUSING ELECTRODE

FIELD OF THE INVENTION

This invention relates to photomultiplier tubes, and in particular to a low profile photomultiplier tube having a dynode cage that includes a focusing electrode for improving the transfer of electrons from a first dynode array to a second dynode array.

BACKGROUND OF THE INVENTION

Among the known dynode structures for photomultiplier tube cages are the box-and-grid dynode structure and the in-line dynode structure. The box-and-grid dynode structure provides excellent electron collection efficiency, but the electron transit time between dynodes leaves something to be desired. The in-line dynode structure provides significantly faster response than the box-and-grid dynode structure.

It is known to combine a box-and-grid dynode structure with an in-line dynode structure to obtain the advantages of both of those arrangements in a photomultiplier tube. Such an arrangement is shown and described in U.S. Pat. No. 5,578,891. However, such tubes necessarily have long profiles. More recently, it has become desirable to shorten the profile of photomultiplier tubes in order to reduce the size of the devices in which they are often used, e.g., scintillation counting devices. One approach to shortening the profile of a photomultiplier tube that utilizes a box-and-grid dynode structure in combination with an in-line dynode structure is shown and described in U.S. Pat. No. 5,598,061.

The need for greater compactness and efficiency of operation in photomultiplier tubes is ever present. Therefore, it would be highly desirable to have a short profile photomultiplier tube that provides the advantages of the box-and-grid and in-line dynode structures, and which provides a better combination of collection efficiency and compactness than the known short profile photomultiplier tube arrangements.

SUMMARY OF THE INVENTION

A photomultiplier tube in accordance with the present invention includes an envelope having a faceplate. A photocathode is disposed on the faceplate, inside the envelope, for receiving light incident on the faceplate. A first dynode array having a first dynode is positioned in the envelope for receiving electrons from the photocathode. The first dynode array also has a last dynode and a major axis extending between the first and last dynodes.

A second dynode array is disposed in the envelope adjacent to the first dynode array. The second dynode has a first dynode and an ultimate dynode positioned along a second major axis that is substantially orthogonal to the major axis of the first dynode array.

A focusing electrode is positioned between the last dynode of the first dynode array and the first dynode of the second dynode array. The focusing electrode is constructed and arranged to transfer electrons emitted from the last dynode of the first array to the first dynode of the second dynode array. The photomultiplier tube according to the present invention also includes an anode disposed in the envelope adjacent to the ultimate dynode.

BRIEF DESCRIPTION OF THE DRAWINGS

Further novel features and advantages of the present invention will become apparent from the following detailed description and the accompanying drawings in which.

DETAILED DESCRIPTION

Figure 1:
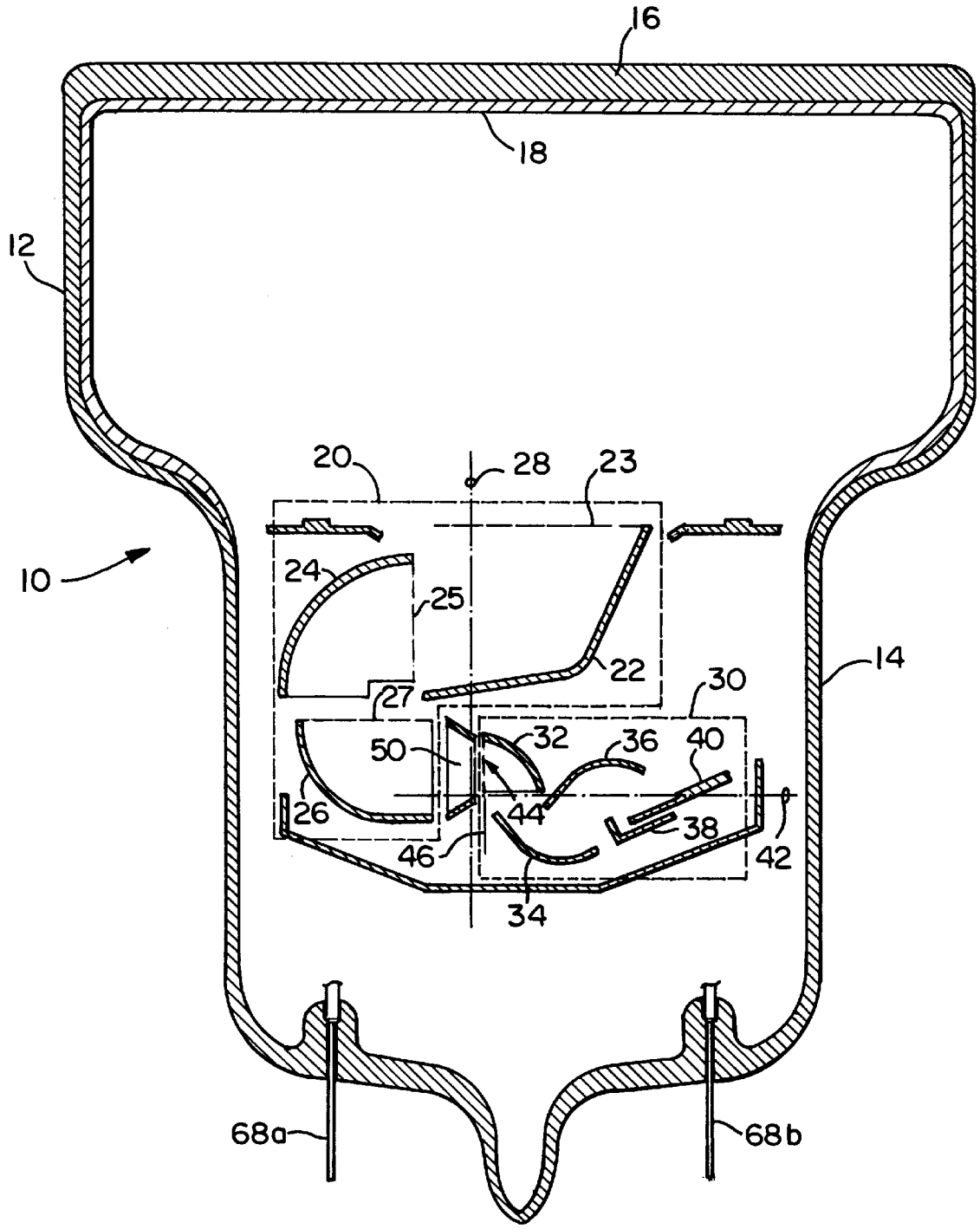
FIG. 1 is a cross-sectional elevation view of a photomultiplier tube in accordance with the present invention.

Referring now to the drawings wherein like reference numerals refer to the same or similar components across the several views, and in particular to FIG. 1, there is shown a photomultiplier tube 10 in accordance with the present invention. Photomultiplier tube 10 includes an evacuated envelope or vessel 12 which has a cylindrical wall 14 and a faceplate 16. A photocathode 18 is formed on an interior surface of faceplate 16 and on the interior surface of a portion of cylindrical wall 14. Light incident on the faceplate 16 enters the envelope 12. The photocathode 18 converts the incident light into a plurality of photoelectrons.

Arranged in the interior of envelope 12 is a dynode cage which includes a first or front-end dynode array 20 and a second dynode array 30, including an anode 40. The first dynode array 20 has a major axis 28 and the second dynode array 30 has a major axis 42 that is substantially orthogonal to the major axis 28 of the first dynode array. With this arrangement the profile of the dynode cage, and hence the photomultiplier tube 10, is considerably shortened relative to the known photomultiplier tubes. It is not essential that the major axis 42 and major axis 28 be precisely perpendicular relative to one another. However, they should be substantially orthogonal in order to provide the desired shortening of the photomultiplier tube profile. To the extent that it does not result in a significant adverse effect on the operation of the photomultiplier tube 10, the angular relationship between axis 42 and axis 28 can be made more acute so that the tube profile can be shortened to a greater degree than that shown in FIG. 1.

The dynode cage multiplies the photoelectrons from the photocathode 18 incident thereon to provide a desired amount of electron gain. The front end dynode array 20 includes a first dynode 22 which is oriented for receiving photoelectrons from the photocathode 18. First dynode 22 preferably includes a grid 23 disposed over the electron inlet aperture thereof. A second dynode 24 in the front-end dynode array 20 is positioned adjacent to the first dynode 22. The second dynode 24 preferably has a grid 25 disposed over the electron inlet aperture thereof. The second dynode 24 is positioned so that its electron inlet aperture faces the electron outlet aperture of first dynode 22. A third dynode 26 is disposed adjacent to the second dynode 24 in the front-end dynode array 20. The third dynode 26 has a grid 27 disposed over the electron inlet aperture thereof and is positioned so that its electron inlet aperture faces the electron outlet aperture of second dynode 24. Preferably, the first dynode 22, second dynode 24 and third dynode 26 are of the known box-and-grid construction.

The second dynode array 30, which is preferably configured as an in-line dynode array, includes a first dynode 32, a second dynode 34, a third dynode 36, and a fourth or ultimate dynode 38. The first dynode 32, second dynode 34, third dynode 36, and ultimate dynode 38 are constructed and arranged relative to one another in any suitable manner to facilitate the transfer of the stream of electrons 20 to the anode 40.

The dynodes in the dynode cage are formed of a suitable conductive material, including, but not limited to, such metals as nickel or stainless steel. The dynodes are coated with any suitable secondary emitter material, including, but not limited to, such materials as cesium antimonide ($Cs_2Sb$), potassium cesium antimonide ($K_2CsSb$), gallium phosphide, gallium arsenide phosphide, beryllium oxide (BeO:Cs), magnesium oxide (MgO:Cs), or silver oxide (AgO:Cs).

In order to facilitate the transfer of electrons from the first dynode array to the second dynode array, a focusing electrode 50 is disposed between the outlet aperture of the third dynode 26 of the first dynode array 20 and the inlet aperture of the first dynode 32 of the second dynode array 30. The focusing electrode 50 is adapted and arranged for focusing the electrons emerging from the third dynode 26 onto the interior surface of first dynode 32 of the second dynode array 30. The focusing electrode 50 does not amplify the electron signal between the first dynode array and the second dynode array. However, its structure can be varied to provide an optimum electron transfer between the first and second dynode arrays.

Figure 2A:
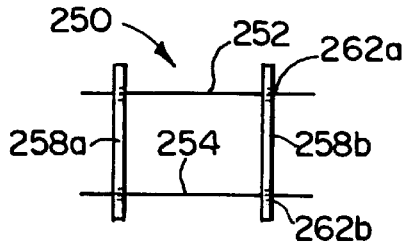
FIGS. 2A, 2B, and 2C are, respectively, a front elevation view, a side elevation view, and a bottom plan view of a focusing electrode used in the photomultiplier tube shown in FIG. 1.
Figure 2B:
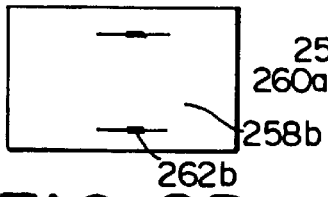
Figure 2C:
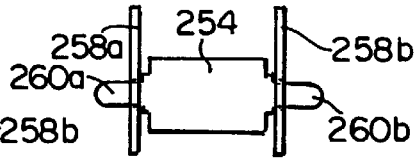

Referring now to FIGS. 2A to 2C, there is shown a first embodiment of a focus electrode 250 in accordance with the present invention. The focus electrode 250 includes a top plate 252 and a bottom plate 254, both of which are formed of a conductive material, preferably nickel, stainless steel, or other suitable metal. However, since the focusing electrode does not provide any electron multiplying function, the plates 252, 254 are not coated with a secondary emitter material. In the embodiments shown in FIGS. 2A, 2B, and 2C, the top plate 252 and bottom plate 254 are oriented substantially parallel to one another. The top plate 252 and bottom plate 254 are supported in the photomultiplier tube by means of a pair of lateral support spacers 258*a* and 258*b* which are formed of an insulating material, preferably a high alumina ceramic. The top plate 252 has a pair of tabs 260*a* and 260*b* extending from the sides thereof. The tabs 260*a*, 260*b* are formed to extend through slots 262*a* and 262*b* in the ceramic supports 258*a*, 258*b*. Bottom plate 254 has a similar pair of tabs which are formed to extend through corresponding slots in the ceramic supports. The tabs on the top and bottom plates also function as connection terminals to which wire leads and/or jumpers are connected to provide an electric potential(s) to the plates for energizing the focus electrode.

Figure 3A:
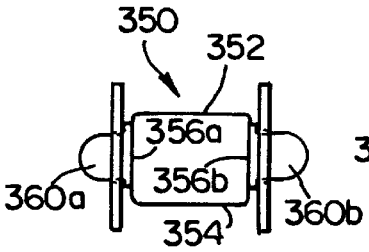
FIGS. 3A, 3B, and 3C are, respectively, a front elevation view, a side elevation view, and a bottom plan view of a second embodiment of a focusing electrode used in the photomultiplier tube shown in FIG. 1.
Figure 3B:
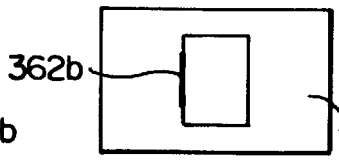
Figure 3C:
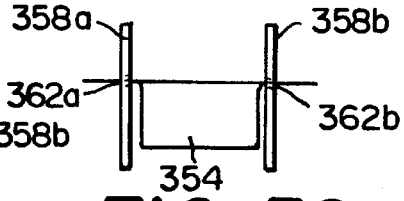

Referring now to FIGS. 3A, 3B, and 3C, there is shown a second embodiment of a focus electrode 350 in accordance with the present invention. The focus electrode 350 has a top plate 352, a bottom plate 354, and a pair of sidewalls 356*a* and 356*b*. The top plate 352, bottom plate 354, and sidewalls 356*a*, 356*b*, define a substantially rectangular channel. The focus electrode 350 is supported in the photomultiplier tube by means of a pair of lateral, ceramic support spacers 358*a* and 358*b*. Tabs 360*a* and 360*b* extend from sidewalls 356*a* and 356*b*, respectively, and through slots 362*a*, 362*b* in ceramic supports 358*a*, 358*b*. One of the tabs 360*a*, 360*b* functions as a connection terminal as described above relative to the embodiment of FIGS. 2A–2C.

Figure 4A:
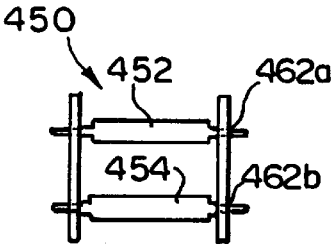
FIGS. 4A, 4B, and 4C are, respectively, a front elevation view, a side elevation view, and a bottom plan view of a third embodiment of a focusing electrode used in the photomultiplier tube shown in FIG. 1.
Figure 4B:
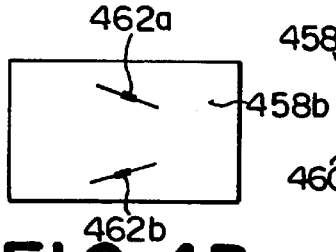
Figure 4C:
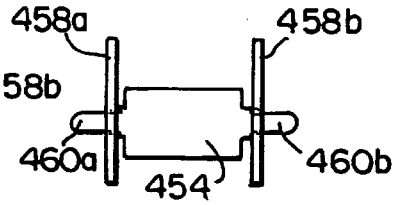

Referring now to FIGS. 4A, 4B, and 4C, there is shown a third embodiment of a focus electrode 450 in accordance with the present invention. The focus electrode 450 includes a top plate 452 and a bottom plate 454 which are oriented at a taper angle relative to each other. Focus electrode 450 is constructed and supported in the photomultiplier tube in a manner similar to that shown in the embodiment of FIGS. 2A–2C.

Figure 5A:
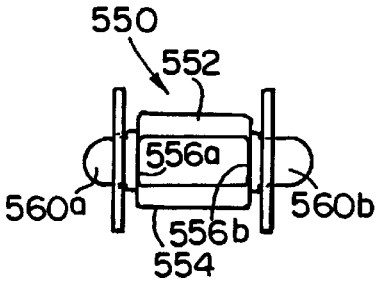
FIGS. 5A, 5B, and 5C are, respectively, a front elevation view, a side elevation view, and a bottom plan view of a fourth embodiment of a focusing electrode used in the photomultiplier tube shown in FIG. 1.
Figure 5B:
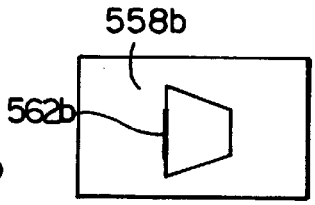
Figure 5C:
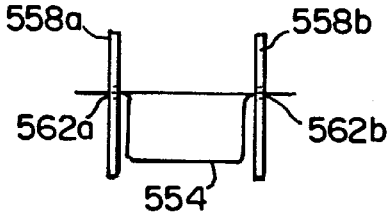

Referring now to FIGS. 5A, 5B, and 5C, there is shown a fourth embodiment of a focus electrode 550 in accordance with the present invention. The focus electrode 550 has a top plate 552, a bottom plate 554, and a pair of sidewalls 556*a* and 556*b*. Top plate 552 and bottom plate 554 are oriented at a taper angle relative to each other. The top plate 552, bottom plate 554, and sidewalls 556*a*, 556*b*, define a tapered channel having a substantially rectangular cross-section. Focus electrode 550 is constructed and supported in the photomultiplier tube in a manner similar to that shown in the embodiment of FIGS. 3A–3C.

Figure 6A:
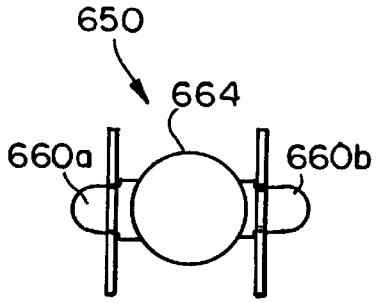
FIGS. 6A, 6B, and 6C are, respectively, a front elevation view, a side elevation view, and a bottom plan view of a fifth embodiment of a focusing electrode used in the photomultiplier tube shown in FIG. 1.
Figure 6B:
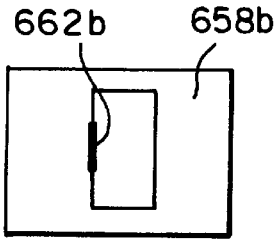
Figure 6C:
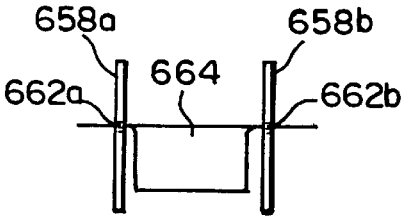

Referring now to FIGS. 6A, 6B, and 6C, there is shown a fifth embodiment of a focus electrode 650 in accordance with the present invention. The focus electrode 650 has a cylindrical wall 664. The cylindrical wall 664 defines a substantially circular channel. The focus electrode 650 is supported in the photomultiplier tube by means of a pair of lateral, ceramic support spacers 658*a* and 658*b*. Tabs 660*a* and 660*b* extend from opposite sides of cylindrical wall 664 and through slots 662*a* and 662*b* in ceramic supports 658*a* and 658*b*, respectively.

Figure 7A:
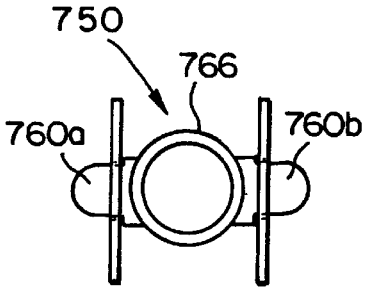
FIGS. 7A, 7B, and 7C are, respectively, a front elevation view, a side elevation view, and a bottom plan view of a sixth embodiment of a focusing electrode used in the photomultiplier tube shown in FIG. 1.
Figure 7B:
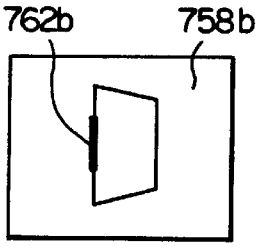
Figure 7C:
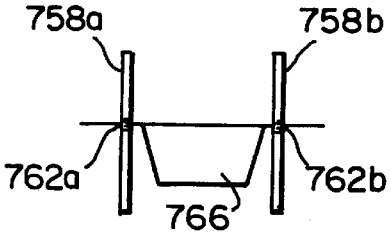

Referring now to FIGS. 7A, 7B, and 7C, there is shown a sixth embodiment of a focus electrode 750 in accordance with the present invention. The focus electrode 750 has a wall 766 that is in the shape of a conical frustum. The wall 766 defines a tapered channel having a substantially circular cross-section. Focus electrode 750 is constructed and supported in the photomultiplier tube in a manner similar to that shown in the embodiment of FIGS. 6A–6C.

Figure 8A:
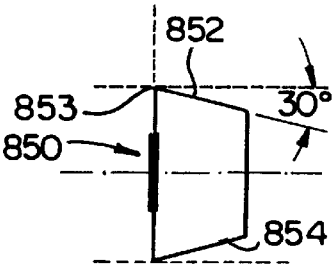
FIGS. 8A, 8B, and 8C are side elevation views of a focusing electrode used in the photomultiplier according to this invention showing the range of taper angles that can be used and how the taper angle is determined.
Figure 8B:
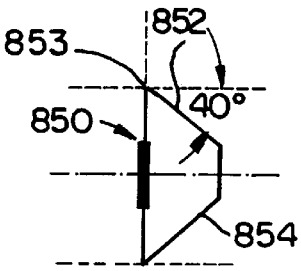
Figure 8C:
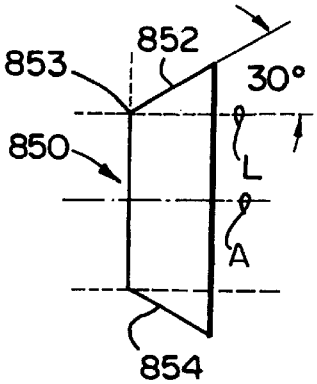

The focus electrodes shown in FIGS. 4A–4C, 5A–5C, and 7A–7C have top and bottom plates or walls that are oriented at a taper angle relative to each other. FIGS. 8A, 8B, and 8C show how the taper angle of the focus electrode is defined in accordance with the present invention. The taper angle is defined as the angle subtended by a line parallel to the surface of the plate 852 of the focus electrode 850 and a line L that is parallel to the principle axis A of the focus electrode 850 and which intersects an outer edge 853 of the inlet side of the upper plate or upper wall portion of the focus electrode. The preferred taper angle range is from about −40° (FIG. 8A) to about +30° (FIG. 8B) relative to line L. Good results have been obtained with a taper angle of approximately −30° (FIG. 8C).

Figure 9A:
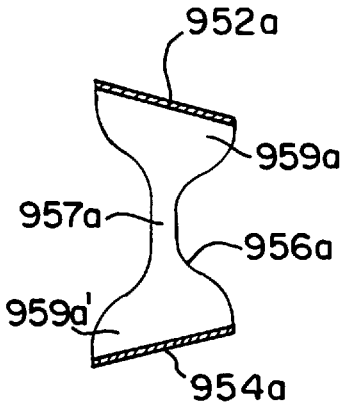
FIGS. 9A, 9B, 9C, 9D, 9E, and 9F, are side elevation views of a focusing electrode used in the photomultiplier tube according to this invention showing various arrangements of the sidewalls for the focus electrode.
Figure 9B:
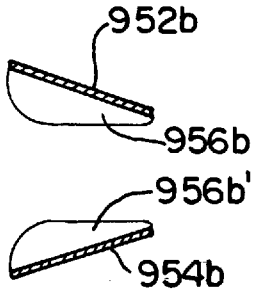
Figure 9C:
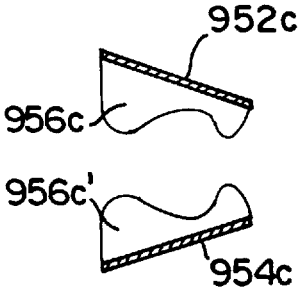

In the embodiments of the focus electrode shown in FIGS. 3A–3C, 5A–5C, 6A–6C, and 7A–7C, the sidewalls may extend continuously between the top and bottom plates or may extend only partially from the top and bottom plates so as to form end-flaps. Referring now to FIGS. 9A to 9C, there are shown embodiments of the sidewalls for the focus electrode used in the photomultiplier tube according to this invention in which the top and bottom plates are oriented at a taper angle relative to each other. As shown in FIG. 9A, the sidewall 956*a* extends continuously between the top plate 952*a* and the bottom plate 954*a* of the focus electrode. The sidewall 956*a* has a neck portion 957*a* which interconnects an upper curved portion 959*a* attached to the top plate 952*a* and a lower curved portion 959*a*' attached to the bottom plate 954*a*.

Figure 9D:
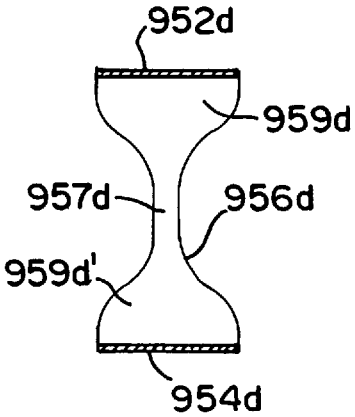
Figure 9E:
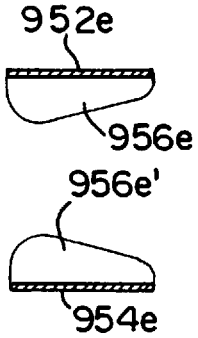
Figure 9F:
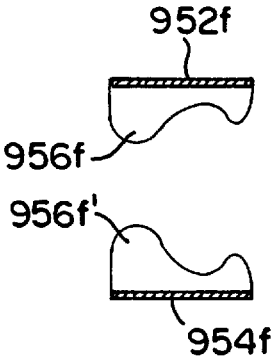

As shown in FIG. 9B the focus electrode sidewall is configured as a pair of end-flaps 956*b* and 956*b*' which are not interconnected. End-flap 956*b* extends from top plate 952*b* toward bottom plate 954*b* and end-flap 956*b*' extends from bottom plate 954*b* toward top plate 952*b*. The free edges of end-flaps 956*b* and 956*b*' are curved in a manner selected to provide a desired level of efficiency of transfer of the secondary electrons from the first dynode array to the second dynode array. FIG. 9C shows a sidewall arrangement similar to that of FIG. 9B in which the edge curvature of the end-flaps 956*c* and 956*c*' has a different configuration from that shown in FIG. 9B. In FIGS. 9D to 9F, there are shown embodiments of the sidewalls for the focus electrode used in the photomultiplier tube according to this invention in which the top and bottom plates are parallel to each other. The sidewall structures of the focus electrodes shown in FIGS. 9D, 9E, and 9F correspond to those shown in FIGS. 9A, 9B, and 9C, respectively. Those skilled in the art will be able to design other sidewall arrangements that provide desired transfer and collection characteristics for various dynode cage arrangements in accordance with the present invention. In addition to the embodiments of the focus electrode described and shown herein, it is also contemplated that the focus electrode can be constructed to provide a curved input edge, a curved output edge, or both.

Figure 10:
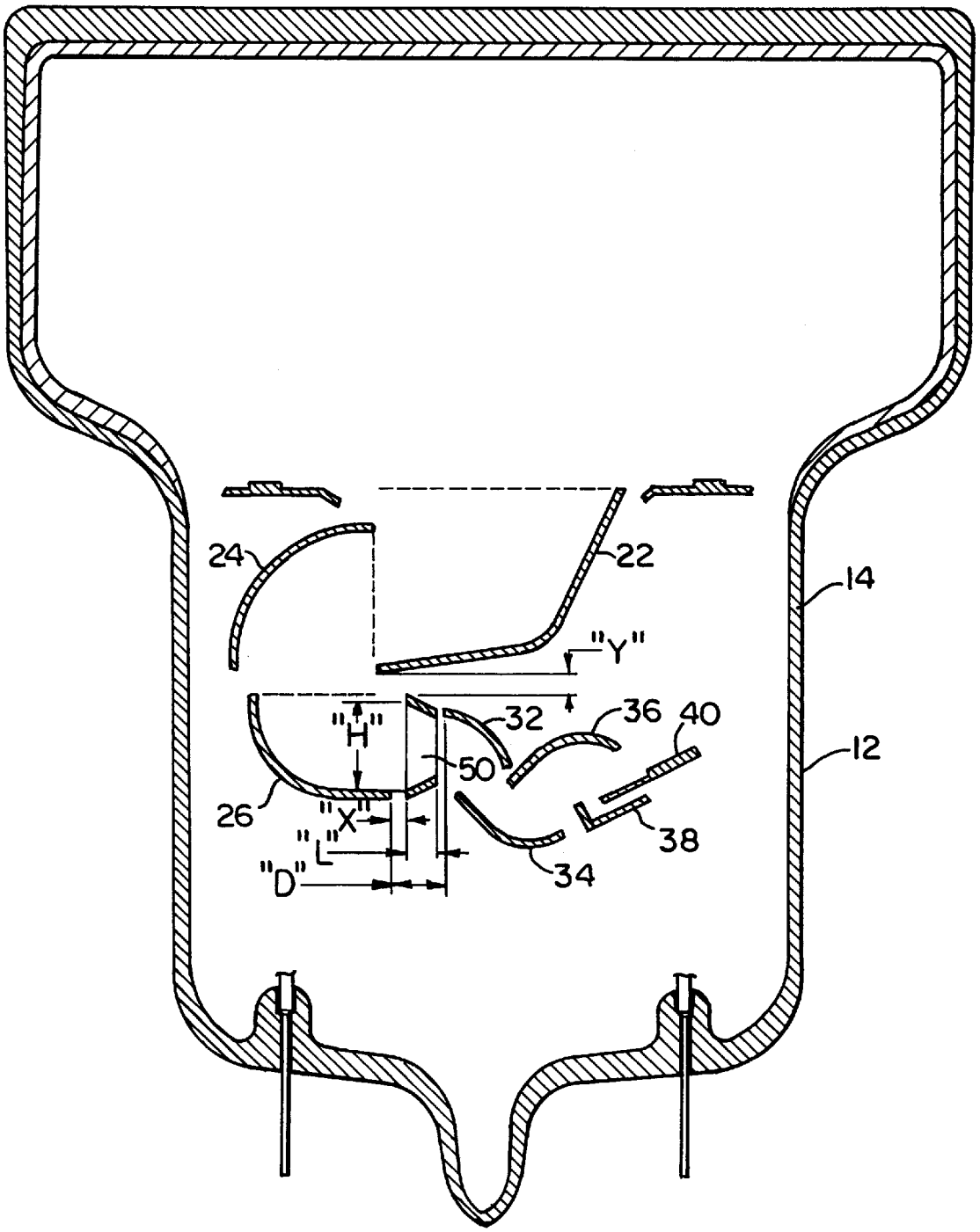
FIG. 10 is a further cross-sectional elevation view of the photomultiplier tube shown in FIG. 1 which shows details of the spatial and geometric relationships of the dynodes and the focus electrode used therein.

Referring now to FIG. 10, the input edge of focus electrode 50 is positioned a distance "X" from the output edge of dynode 26. The input edge of dynode 32 is positioned a distance "D" from the output edge of dynode 26. The focus electrode 50 has a length "L". In the photomultiplier tube according to this invention the focus electrode is positioned such that the relationship $X+L<D$ is satisfied and X is in the range: $\frac{1}{5} D \leqq X < D$. Preferably, X is about ¼ of the distance D. The upper limit of the range for X occurs in the situation where the focus electrode is very narrow, for example, where the focus electrode is configured as a thin ring or frame, either with or without a mesh grid.

The outer surface of focus electrode 50 is positioned a distance "Y" from the nearest point of the outer surface of dynode 22. In the photomultiplier tube according to this invention, the focus electrode is positioned such that Y is in the range: $\frac{1}{3} D \leqq Y \leqq D$. Preferably, Y is about ½ of D.

The focus electrode 50 has an aspect ratio defined as H/L, where the distance "H" is the height of the input aperture of the focus electrode 50. The aspect ratio of the focus electrode is in the range: $1 \leqq H/L \leqq 50$. For a taper angle of −30°, H/L is preferably about 2.7. In an embodiment where the focus electrode has parallel upper and lower plates, i.e., the taper angle is 0°, H/L is preferably about 2.4.

Referring back to FIG. 1, the first dynode 32 of the second dynode array 20 preferably has a mesh grid 46 disposed over its input aperture 44. In an alternative embodiment, the focus electrode 50 has a mesh grid (not shown) positioned over its input aperture, its output aperture, or both. In such an embodiment, the mesh grid 46 on dynode 32 may be included or omitted.

During operation of the photomultiplier tube in accordance with this invention, the focus electrode is maintained at an electric potential intermediate those of dynode 26 and dynode 32. The operating voltage of the focus electrode can be about 20% to 80% of the voltage difference of dynodes 26 and 32. Preferably, the operating voltage of the focus electrode is set at about 50% of the voltage difference of dynode 32 and dynode 26. For example, if the operating voltage of dynode 32 is about 480 v and the operating voltage of dynode 26 is about 320 v, then the operating voltage of the focus would be about 400 v.

In view of the foregoing description and the accompanying drawings, some of the many novel features and advantages of the photomultiplier tube according to this invention are now apparent. In particular, it will be appreciated that the transfer of secondary electrons from the first dynode array to the second dynode array is governed essentially by the focus electrode, not by the first dynode of the second dynode array. In a photomultiplier tube according to this invention, the structure and arrangement of the first dynode of the second dynode array is not critical to that function. Therefore, the design of a photomultiplier tube according to the invention can be simpler relative to the known designs because a known dynode structure can be used instead of a specially designed dynode.

It will be recognized by those skilled in the art that changes or modifications may be made to the above-described invention without departing from the broad inventive concepts of this invention. It is understood, therefore, that the invention is not limited to the particular embodiments disclosed herein, but is intended to cover all modifications and changes which are within the scope of the invention as defined in the appended claims.

What is claimed is:

1. A photomultiplier tube comprising:

an envelope having a faceplate;

a photocathode disposed in said envelope for receiving light incident on the faceplate of said envelope;

a first dynode array having a first dynode disposed in said envelope for receiving electrons from said photocathode, said first dynode array having a last dynode and a first major axis;

a second dynode array disposed in said envelope adjacent to said first dynode array, said second dynode having a first dynode and an ultimate dynode positioned along a second major axis that is oriented substantially orthogonal to the major axis of said first dynode array;

a focusing electrode disposed between the last dynode of said first dynode array and the first dynode of said second dynode array along the second major axis, said focusing electrode being constructed and arranged for transferring electrons emitted from the last dynode of said first dynode array to the first dynode of said second dynode array; and an anode disposed in said envelope adjacent to the ultimate dynode of the second dynode array.

2. A photomultiplier tube as set forth in claim 1 wherein said focusing electrode comprises a top plate and a bottom plate arranged in spaced apart relation to form a gap therebetween.

3. A photomultiplier tube as set forth in claim 2 wherein said focusing electrode comprises a pair of sidewalls disposed between said top plate and bottom plate in spaced apart relation such that said top plate, said bottom plate, and said sidewalls form a channel therebetween.

4. A photomultiplier tube as set forth in claim 2 wherein said top plate and said bottom plate are inclined relative to each other such that the gap has a tapered longitudinal cross-section.

5. A photomultiplier tube as set forth in claim 4 wherein said focusing electrode comprises a pair of sidewalls disposed between said top plate and bottom plate in a spaced apart relation such that said top plate, said bottom plate, and said sidewalls form a tapered channel therebetween.

6. A photomultiplier tube as set forth in claim 1 wherein said focusing electrode comprises a substantially cylindrical wall.

7. A photomultiplier tube as set forth in claim 6 wherein said cylindrical wall is tapered to form a frustum of a cone.

8. A photomultiplier tube as set forth in claim 4, 5, or 7 wherein the focusing electrode has a taper angle of at least about −40° and not more than about 30°.

9. A photomultiplier tube as set forth in claim 8 wherein the taper angle of the focusing electrode is about −30°.

10. A photomultiplier tube as set forth in claim 1 wherein said first dynode of said second dynode array has an input aperture facing said focusing electrode and a grid disposed over said input aperture.

11. A photomultiplier tube as set forth in claim 1 wherein said focusing electrode has an input aperture facing the last dynode of said first dynode array and a grid disposed over said input aperture.

12. A photomultiplier tube comprising:

an envelope having a faceplate;

a photocathode disposed in said envelope for receiving light incident on the faceplate of said envelope;

a box-and-grid dynode array having a first box-and-grid dynode disposed in said envelope for receiving electrons from said photocathode, said box-and-grid dynode array having a last box-and-grid dynode and a first major axis;

a second dynode array disposed in said envelope adjacent to said first dynode array, said second dynode having a first dynode and an ultimate dynode positioned along a second major axis that is oriented substantially orthogonal to the major axis of said first dynode array;

a focusing electrode disposed between the last dynode of said first dynode array and the first dynode of said second dynode array along the second major axis, said focusing electrode being constructed and arranged for transferring electrons emitted from the last dynode of said first dynode array to the first dynode of said second dynode array; and an anode disposed in said envelope adjacent to the ultimate dynode of the second dynode array.

13. A photomultiplier tube as set forth in claim 12 wherein said second dynode array comprises an in-line dynode array.

14. A photomultiplier tube as set forth in claim 12 wherein said focusing electrode comprises a top plate and a bottom plate arranged in spaced apart relation to form a gap therebetween.

15. A photomultiplier tube as set forth in claim 14 wherein said focusing electrode comprises a pair of sidewalls disposed between said top plate and bottom plate in spaced apart relation such that said top plate, said bottom plate, and said sidewalls form a channel therebetween.

16. A photomultiplier tube as set forth in claim 14 wherein said top plate and said bottom plate are inclined relative to each other such that the gap has a tapered longitudinal cross-section.

17. A photomultiplier tube as set forth in claim 16 wherein said focusing electrode comprises a pair of sidewalls disposed between said top plate and bottom plate in a spaced apart relation such that said top plate, said bottom plate, and said sidewalls form a tapered channel therebetween.

18. A photomultiplier tube as set forth in claim 12 wherein said focusing electrode comprises a substantially cylindrical wall.

19. A photomultiplier tube as set forth in claim 18 wherein said cylindrical wall is tapered to form a frustum of a cone.

* * * * *